US010264880B1

(12) United States Patent
Koutny

(10) Patent No.: US 10,264,880 B1
(45) Date of Patent: Apr. 23, 2019

(54) MULTI-CONFIGURATION FURNITURE AND DISPLAY SYSTEM

(71) Applicant: Robert J. Koutny, Bradenton, FL (US)

(72) Inventor: Robert J. Koutny, Bradenton, FL (US)

( * ) Notice: Subject to any disclaimer, the term of this patent is extended or adjusted under 35 U.S.C. 154(b) by 94 days.

(21) Appl. No.: 15/400,240

(22) Filed: Jan. 6, 2017

(51) Int. Cl.

| | |
|---|---|
| ***A47C 13/00*** | (2006.01) |
| ***A47B 85/00*** | (2006.01) |
| ***A47C 7/14*** | (2006.01) |
| ***A47B 45/00*** | (2006.01) |
| ***A47C 4/04*** | (2006.01) |
| ***A47F 5/11*** | (2006.01) |

(52) U.S. Cl.
CPC ..... *A47B 85/00* (2013.01); *A47B 45/00* (2013.01); *A47C 4/04* (2013.01); *A47C 7/14* (2013.01); *A47C 13/00* (2013.01); *A47F 5/116* (2013.01)

(58) Field of Classification Search
CPC ..... A47C 11/00; A47C 13/005; A47C 4/02; A47C 4/028; A47B 87/008; A47B 87/007; A47F 7/144; A47F 7/145; G11B 33/0461; G11B 33/0466; G11B 33/0488; G11B 33/0477
USPC ..... 297/129, 440.1, 440.14, 135; 186/59; 312/198
See application file for complete search history.

(56) References Cited

U.S. PATENT DOCUMENTS

| | | | | |
|---|---|---|---|---|
| 2,100,979 | A | 11/1937 | Rowe | |
| 3,092,301 | A | 4/1963 | Selle | |
| 3,664,705 | A | 5/1972 | Brody et al. | |
| 4,582,003 | A | 3/1986 | Valero | |
| 4,811,987 | A * | 3/1989 | Volpe | A47C 5/005 248/174 |
| 4,877,292 | A | 10/1989 | Volpe et al. | |
| 4,903,451 | A * | 2/1990 | Gresswell | A47B 87/0276 312/111 |
| 6,105,796 | A | 8/2000 | Buchanan et al. | |
| 6,955,268 | B2 * | 10/2005 | Waldron | A47F 7/145 211/194 |
| 7,367,460 | B2 * | 5/2008 | Hirsch | A47F 5/0025 211/11 |
| 7,481,496 | B2 * | 1/2009 | Smith | A47B 83/02 297/440.1 |
| 7,886,465 | B2 | 2/2011 | Virvo | |
| 9,833,079 | B2 * | 12/2017 | Souders | A47C 13/005 |
| 2005/0006943 | A1 * | 1/2005 | Wieland | A47C 4/021 297/440.13 |
| 2008/0236452 | A1 * | 10/2008 | Pratt | A47B 85/00 108/13 |
| 2009/0251034 | A1 * | 10/2009 | Nielsen | A47B 43/02 312/259 |
| 2010/0108623 | A1 | 5/2010 | Virvo | |
| 2011/0259947 | A1 | 10/2011 | Brittain | |
| 2012/0119629 | A1 * | 5/2012 | Nelson | A47B 87/00 312/111 |

(Continued)

*Primary Examiner* — Chi Q Nguyen
(74) *Attorney, Agent, or Firm* — Edward M. Livingston, Esq.; Bryan L. Loeffler, Esq.; Livingston Loeffler, P.A.

(57) ABSTRACT

A furniture and display system (1) having right side structure (2) and left side structure (1) that may be configured to be used as a chair or display in a retail setting. A rear panel (4, 10) of at least one of the two side structures has two panels which form a space to allow the rear panel of a corresponding side structure to be inserted therein to form an elongated shelf or seat. The design of the two pieces allows the side structures to be nested and/or placed together in multiple configurations.

13 Claims, 6 Drawing Sheets

(56) References Cited

U.S. PATENT DOCUMENTS

2016/0128486 A1* 5/2016 Chia ..... A47B 83/02
297/135

* cited by examiner

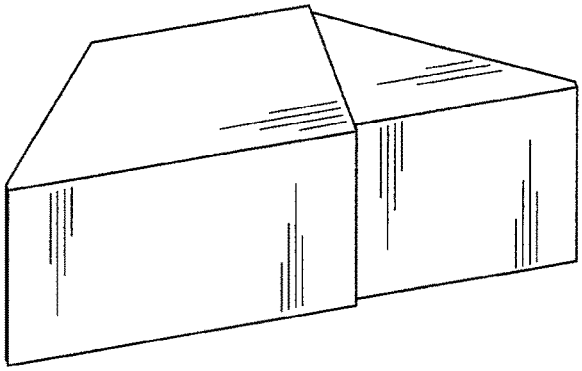
FIG. 22
FIG. 23
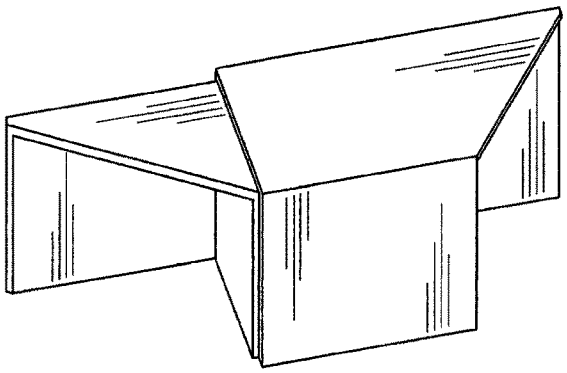
FIG. 24
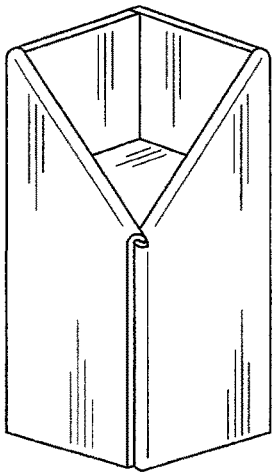
FIG. 25
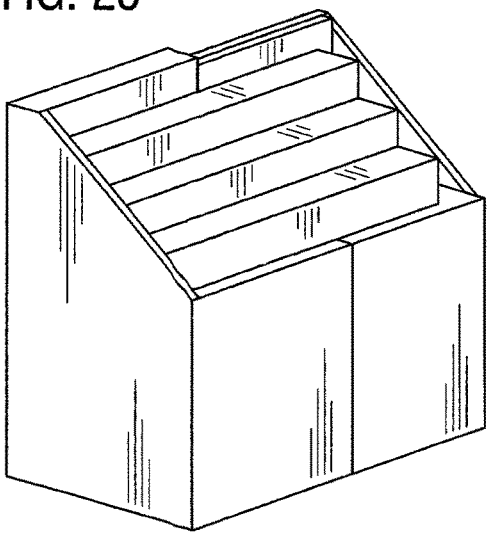

MULTI-CONFIGURATION FURNITURE AND DISPLAY SYSTEM

FIELD OF THE INVENTION

This invention relates to articles of furniture and more particularly a furniture and display system capable of being arranged into multiple configurations to be used as seating, tables, retail displays and so forth.

BACKGROUND OF THE INVENTION

Seating, tables, storage and merchandise displays are constantly changed and re-arranged in retail settings. Such fixtures or pieces of furniture may be temporary disposable articles or more permanent type pieces. Disposable articles create a great deal of waste and more permanent pieces typically only offer limited uses and thus can only be used when a specified need arises. These permanent pieces must then be stored when not in use, which takes up valuable storage space.

Therefore, a need exists for a furniture and display system capable of being arranged into multiple configurations to be used as seating, tables, storage, merchandise displays and so forth.

SUMMARY OF THE INVENTION

The primary object of the present invention is to provide a furniture and display system capable of being arranged into multiple configurations to be used as seating, tables, storage, merchandise displays and so forth.

The present invention fulfills the above and other objects by a providing furniture and display system having a right side structure and a left side structure that may be configured together to be used as a chair or display in a retail setting. A rear panel of at least one of the two side structures has two panels which form a space to allow the rear panel of the second side structure to be inserted therein to form an elongated shelf or seat. The design of the two pieces allows the pieces to be nested together in multiple configurations. Inserts may be provided, such as shelves, signs, dividers, leveling pieces and so forth to further adapt the furniture and display system for various uses.

The present invention allows for multiple configurations, such as seating, shelving, floor displays, countertop displays, point of purchase displays, tables, mannequin bases, dump bins and so forth. Such configurations may be achieved by using one, two or a plurality of side structures to create various shaped-configurations.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which:

FIG. 22 is a perspective front view of a furniture and display system of the present invention configured as a table;

FIG. 23 is a perspective rear view of a furniture and display system of the present invention configured as a table;

FIG. 24 is a perspective front view of a furniture and display system of the present invention configured as a dump bin; and FIG. 25 is a perspective left side view of a furniture and display system of the present invention configured as a point of purchase display.

DESCRIPTION OF THE PREFERRED EMBODIMENTS

Figure 1:
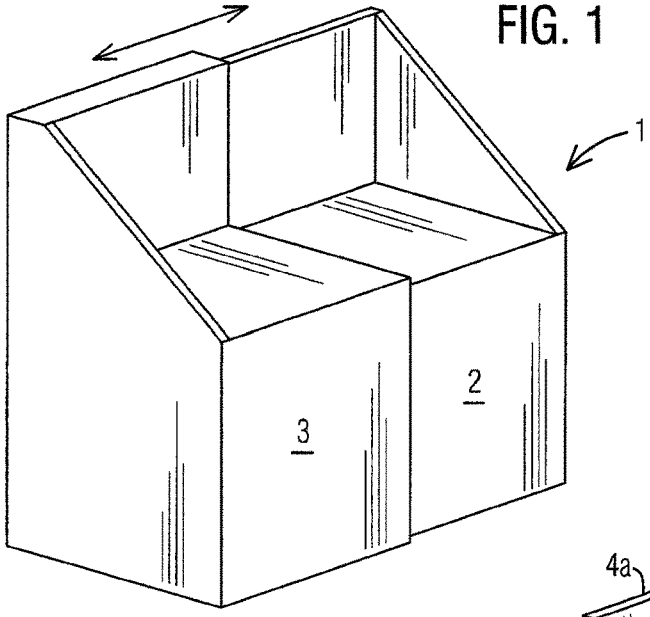
FIG. 1 is a perspective left side view of a furniture and display system of the present invention having a right side structure and a left side structure nested together in a primary configuration in which the left rear panel has a full rear panel and a partial rear panel.
Figure 4:
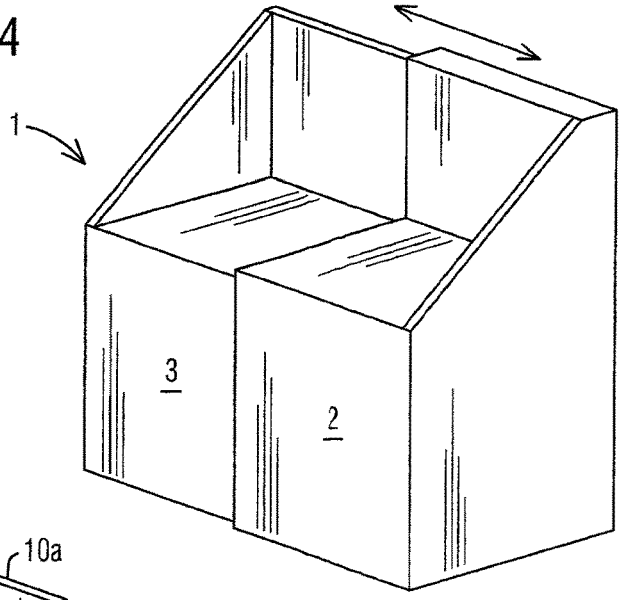
FIG. 4 is a perspective right side view of a furniture and display system of the present invention having a right side structure and a left side structure nested together in a primary configuration in which the right rear panel has a full rear panel and a partial rear panel.

For purposes of describing the preferred embodiment, the terminology used in reference to the numbered accessories in the drawings is as follows:

1. furniture and display system, generally
2. right side structure
3. left side structure
4. right rear panel
4*a*. top edge
4*b*. bottom edge
4*c*. left side edge
4*d*. right side edge
4*e*. full rear panel
4*f*. partial rear panel
4*g*. top rear panel
5. right side panel
5*a*. top edge
5*b*. bottom edge
5*c*. rear edge
5*d*. front edge
6. right rear corner
7. right front panel
7*a*. top edge
7*b*. bottom edge
7*c*. right side edge
7*d*. left side edge
8. right front corner
8*a*. top of right front corner
9. right horizontal support panel
9*a*. front edge
9*b*. rear edge
9*c*. right side edge
9*d*. left side edge
10. left rear panel
10*a*. top edge
10*b*. bottom edge
10*c*. left side edge
10*d*. right side edge
10*e*. full rear panel
10*f*. partial rear panel
10*g*. top rear panel
11. left side panel
11*a*. top edge
11*b*. bottom edge
11*c*. rear edge
11*d*. front edge
12. left rear corner
13. left front panel
13*a*. top edge
13*b*. bottom edge
13*c*. right side edge
13*d*. left side edge
14. left front corner
14*a*. top of left front corner
15. left horizontal support panel
15*a*. front edge
15*b*. rear edge
15*c*. right side edge
15*d*. left side edge
16. leveling insert
17. shelving insert
18. divider insert
19. foldable sheet
19*a*. front surface
19*b*. a rear surface
19*c*. top edge
19*d*. bottom edge
19*e*. left side edge
19*f*. right side edge
19*g*. inner vertical edge
19*h*. inner horizontal edge
19*i*. first foldable sheet
19*j*. second foldable sheet
19*k*. third foldable sheet
19*l*. fourth foldable sheet
20. right folded seat support
21. left folded seat support
22. right folded corner support
23. left folded corner support
24. central axis of foldable sheet With reference to FIGS. 1 and 4, the furniture and display system 1 of the present invention comprises a right side structure 2 and a left side structure 3 that are capable of being nested together in a primary configuration or placed together in a variety of other configurations. As described below, the right side structure 2 and the left side structure 3 are substantial mirror images of each other.

Figure 2:
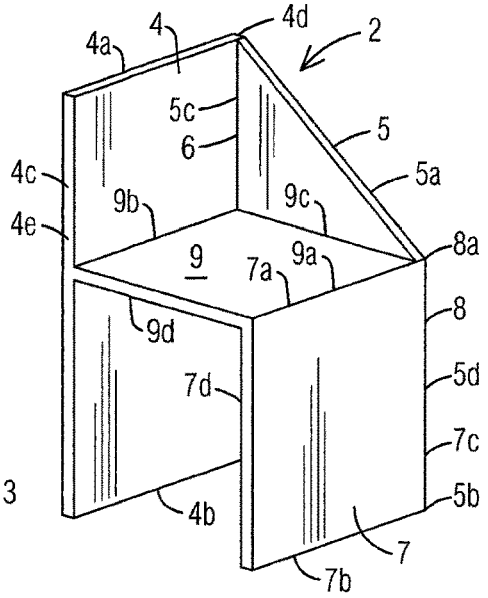
FIG. 2 is a perspective left side view of the right side structure of the present invention in which the right rear panel is a single panel.
Figure 5:
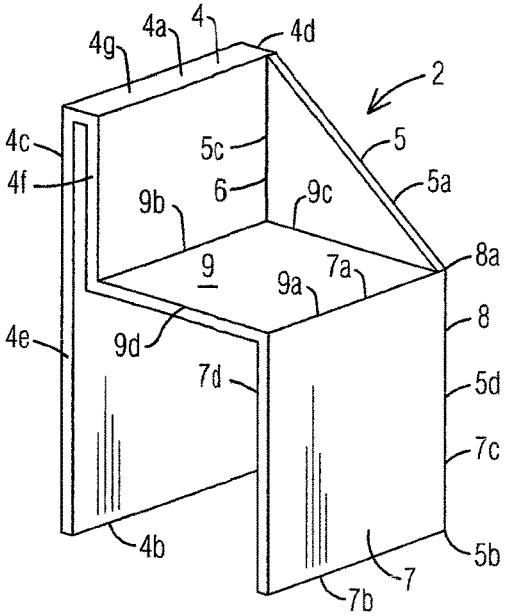
FIG. 5 is a perspective left side view of the right side structure of the present invention in which the right rear panel has a full rear panel and a partial rear panel.

With reference to FIGS. 2 and 5, a perspective left side view of the right side structure 2 of the present invention is illustrated. Said right side structure 2 comprises a substantially rectangular-shaped right rear panel 4 having a top edge 4*a*, bottom edge 4*b*, left side edge 4*c* and right side edge 4*d*. A right side panel 5 extends perpendicularly from the right side edge 4*d* of the right rear panel 4. Said right side panel 5 comprises a top edge 5*a*, a bottom edge 5*b*, a rear edge 5*c* (which shares a right rear corner 6 with the right side edge 4*d* of the right rear panel 4) and a front edge 5*d*. The top edge 5*a* of the right side panel 5 is preferably angled in relation to the bottom edge 5*b* or the top edge 5*a* may be parallel to the bottom edge 5*b* to create a rectangular-shaped right side panel 5. A substantially rectangular-shaped right front panel 7 extends perpendicularly from the front edge 5*d* of the right side panel 5. Said right front panel 7 comprises top edge 7*a*, a bottom edge 7*b*, a right side edge 7*c* (which shares a right front corner 8 with the front edge 5*d* of the right side panel 5) and a left side edge 7*d*. The top edge 7*a* of the right front panel 7 preferably terminates at a top 8*a* of the right front corner 8 where the top edge 5*a* of the right side panel 5 is angled upward in relation to the bottom edge 5*b* of the right side panel 5. A substantially rectangular-shaped right horizontal support panel 9 is located between the right rear panel 4, the right side panel 5 and the right front panel 7 and is perpendicularly oriented in relation to the right rear panel 4, the right side panel 5 and the right front panel 7. The right horizontal support panel 9 comprises a front edge 9*a*, a rear edge 9*b*, a right side edge 9*c* and a left side edge 9*d*. The front edge 9*a* of the right horizontal support panel 9 is preferably directly adjacent to the top edge 7*a* of the right front panel 7. The three-sided configuration of the right side structure 2 provides open accessible spaces above and below the right horizontal support panel 9 that allows the right side structure 2 and the left side structure 3 to be nested together in various configurations.

Figure 3:
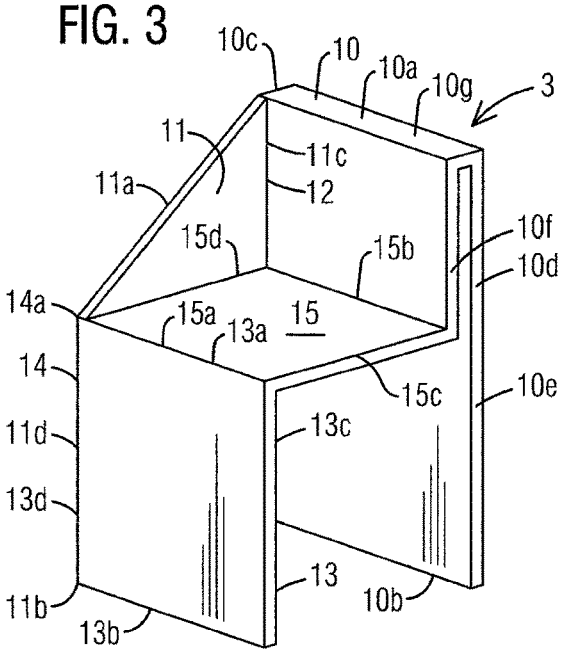
FIG. 3 is a right side perspective view of the left side structure of the present invention in which the left rear panel has a full rear panel and a partial rear panel.
Figure 6:
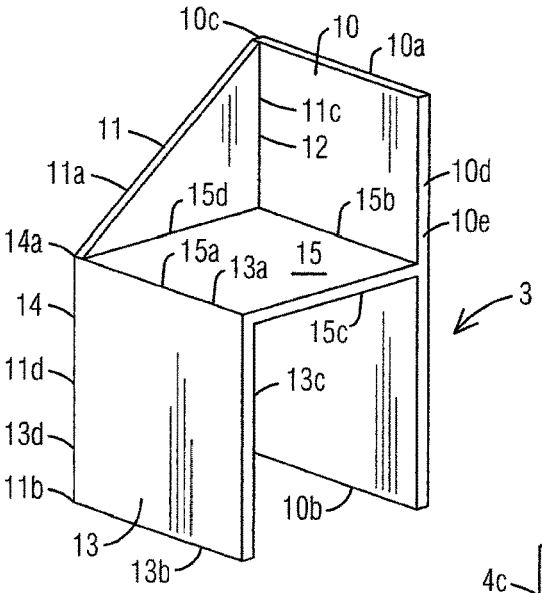
FIG. 6 is a right side perspective view of the left side structure of the present invention in which the left rear panel is a single panel.

With reference to FIGS. 3 and 6, a right side perspective view of the left side structure 3 of the present invention is illustrated. Said left side structure 3 comprises a substantially rectangular-shaped left rear panel 10 having a top edge 10*a*, bottom edge 10*b*, left side edge 10*c* and right side edge 10*d*. A left side panel 11 extends perpendicularly from the left side edge 10*c* of the left rear panel 10. Said left side panel 11 comprises a top edge 11*a*, a bottom edge 11*b*, a rear edge 11*c* (which shares a left rear corner 12 with the left side edge 10*c* of the left rear panel 10) and a front edge 11*d*. The top edge 11*a* of the left side panel 11 is preferably angled in relation to the bottom edge 11*b* or the top edge 11*a* may be parallel to the bottom edge 11*b* to create a rectangular-shaped left side panel 11. A substantially rectangular-shaped left front panel 13 extends perpendicularly from the front edge 11*d* of the left side panel 11. Said left front panel 13 comprises top edge 13*a*, a bottom edge 13*b*, a right side edge 13*c* (which shares a left front corner 14 with the front edge 11*d* of the left side panel 11) and a left side edge 13*d*. The top edge 13*a* of the left front panel 13 preferably terminates at a top 14*a* of the left front corner 14 where the top edge 11*a* of the left side panel 11 is angled upward in relation to the bottom edge 11*b* of the left side panel 11. A substantially rectangular-shaped left horizontal support panel 15 is located between the left rear panel 10, the left side panel 11 and the left front panel 13 and is perpendicularly oriented in relation to the left rear panel 10, the left side panel 11 and the left front panel 13. The left horizontal support panel 15 comprises a front edge 15*a*, a rear edge 15*b*, a right side edge 15*c* and a left side edge 15*d*. The front edge 15*a* of the left horizontal support panel 15 is preferably directly adjacent to the top edge 13*a* of the left front panel 13. The three-sided configuration of the left side structure 3 provides open accessible spaces above and below the right horizontal support panel 15 that allows the right side structure 2 and the left side structure 3 to be nested together in various configurations.

As illustrated in FIG. 3, the left rear panel 10 comprises two panels one of which is a full rear panel 10*e* and the second of which is a partial rear panel 10*f* each of which are spaced apart a predetermined distance by a top rear panel 10*g*. The partial panel 10*f* extends upward from the rear edge 15*b* of the left horizontal support panel 15 and terminates at the top edge 10*a* of the left rear panel 10. The full rear panel 10*e* and partial rear panel 10*f* create a nesting space into which the right rear panel 4 may be inserted into in order to connect the right side structure 2 to the left side structure 3, as illustrated in FIG. 1. Alternatively, the right rear panel 4 may comprise two panels one of which is a full rear panel 4*e* and the second of which is a partial rear panel 4*f* each of which are spaced apart a predetermined distance by a top rear panel 4*g*. As illustrated in FIG. 5, the left rear panel 10 may comprise a single panel as illustrated in FIG. 6 and the left side structure 3 may be inserted into the right left side structure 2, as illustrated in FIG. 4.

Figure 8:
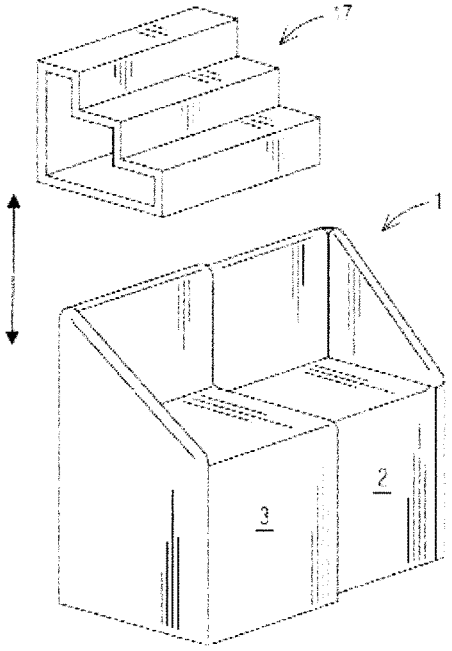
FIG. 8 is a perspective left side view of a shelving insert of the present invention.
Figure 7:
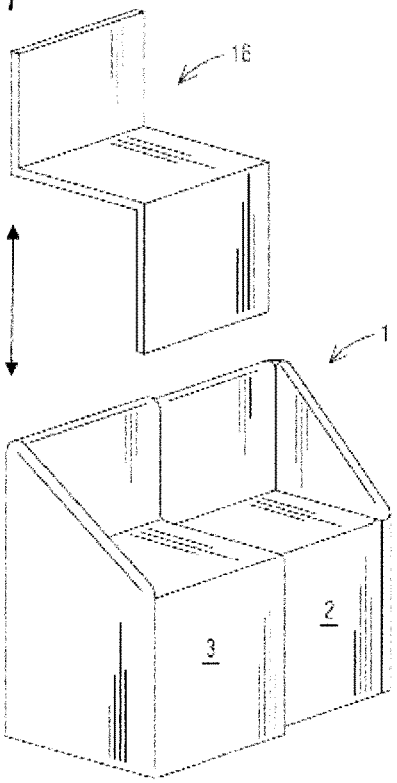
FIG. 7 is a perspective left side view of a leveling insert of the present invention.
Figure 9:
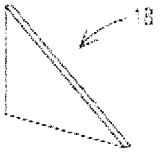
FIG. 9 is a perspective left side view of a divider insert of the present invention.

As illustrated in FIGS. 1 and 4, the nesting of the right side structure 2 and the left side structure 3 creates an offset on the side having a single paneled rear panel. These offsets may be corrected using a leveling insert 16, as illustrated in FIG. 7, which comprises one or more rectangular shaped panels that create a flush even surface when placed over the offset area of the furniture and display system 1 of the present invention. Additional inserts may include shelving inserts 17, as illustrated in FIG. 8, divider inserts 18, as illustrated in FIG. 9, and so forth.

The furniture and display system 1 of the present invention may be a rigid structure or constructed out of a paper cardboard or similar foldable material as illustrated in FIGS. 10-21 and FIG. 24, that allows the furniture and display system 1 to be easily shipped and the assembled for quick use. The foldable furniture and display system 1 of the present invention comprises four sheets 19 each having substantially the same shape and dimensions. Each sheet 19 comprises a front surface 19*a*, a rear surface 19*b*, top edge 19*c*, a bottom edge 19*d*, a left side edge 19*e* and a right side edge 19*f*. Said right side edge 19*f* has a length that is two thirds the length of the left side edge 19*e*. Said top edge 19*c* has a length that is half the length of the bottom edge 19*d*, thereby creating a cutout having an inner vertical edge 19*g* and inner horizontal edge 19*h*. Said inner vertical edge 19*g* has a length that is equal to the length of the top edge 19*c* and said inner horizontal edge 19*h* has a length that is equal to the length of the top edge 19*c*. Each of the four sheets 19 may be split into five substantially equal sized rectangular-shaped quadrants labeled A through E, as illustrated in FIG. 11

Figure 16:
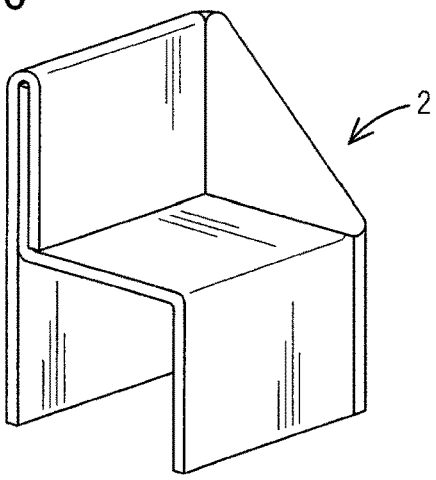
FIG. 16 is a perspective left side view of a folded right side structure.
Figure 21:
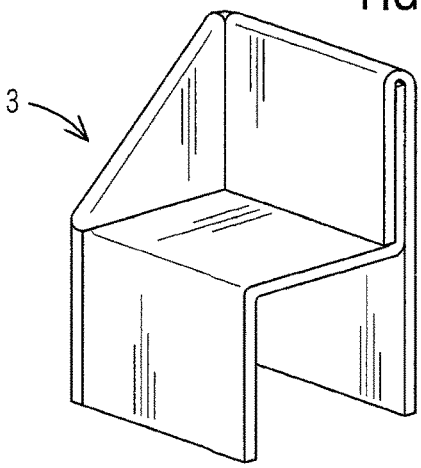
FIG. 21 is a perspective right side view of a folded left side structure.

The four sheets 19 may be folded to create a right side structure 2 and a left side structure 3, as illustrated in FIGS. 16 and 21 respectively. The right side structure 2 and left side structure 3 each comprise a folded seat support 20 and 21 and folded corner support 22 and 23.

Figure 12:
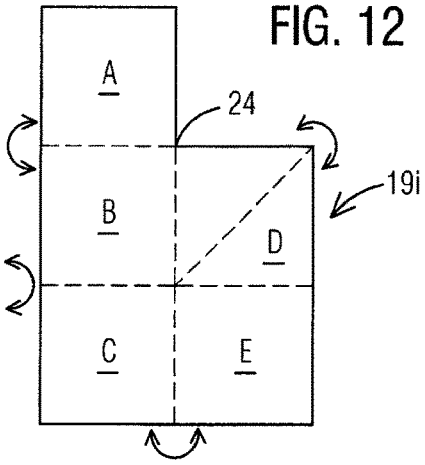
FIG. 12 is a top view of an unfolded right folded seat support.
Figure 13:
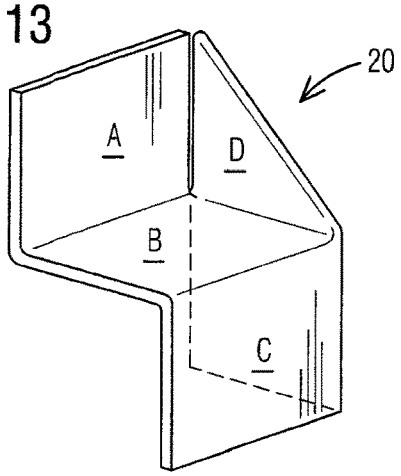
FIG. 13 is a perspective left side view of a folded right folded seat support.

As illustrated in FIGS. 12 and 13, the right side structure 2 comprises a right folded seat support 20 folded out of a first sheet 19*i* wherein quadrant A is folded downward over quadrant B and quadrant D is folded in half to create a forty five degree angle. Then, quadrants A, B and C are folded inward to meet quadrants D and E to create a ninety degree angle along a central axis 24.

Figure 14:
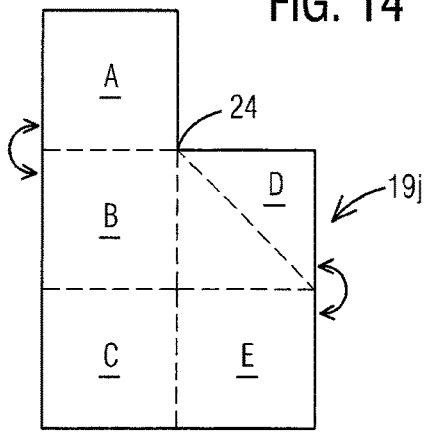
FIG. 14 is a top view of an unfolded right folded corner support.
Figure 15:
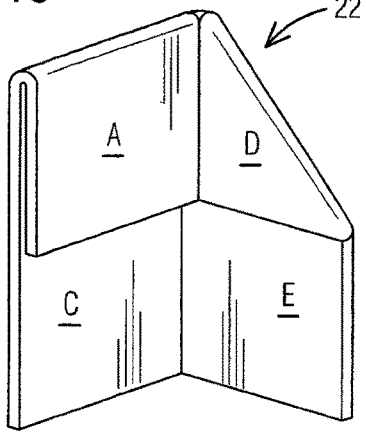
FIG. 15 is a perspective left side view of a folded right folded corner support.

As illustrated in FIGS. 14 and 15, the right side structure 2 further comprises a right folded corner support 22 folded out of a second sheet 19*j* wherein quadrant A is folded at a ninety degree angle in relation to quadrant B. Quadrants B and C are folded at a ninety degree angle in relation to quadrants D and E. Then, quadrant D is folded in half to create a forty five degree angle as quadrant E is folded inward along the central axis 24 to create a ninety degree angle between quadrants C and E.

The right folded seat support 20 may then be inserted or nested into the right folded corner support 22 to create the right side structure 2 as illustrated in FIG. 16.

Figure 18:
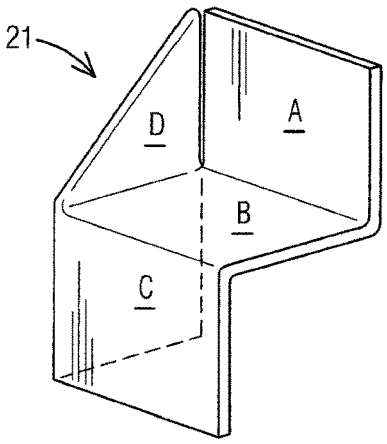
FIG. 18 is a perspective right side view of a folded left folded seat support.
Figure 17:
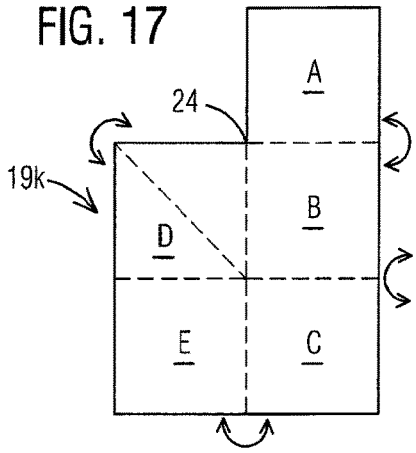
FIG. 17 is a top view of an unfolded left folded seat support.

As illustrated in FIGS. 17 and 18, the left side structure 3 comprises a left folded seat support 21 folded out of a third sheet 19*k* wherein quadrant A is folded downward over quadrant B and quadrant D is folded in half to create a forty five degree angle. Then, quadrants A, B and C are folded inward to meet quadrants D and E to create a ninety degree angle along the central axis 24.

Figure 19:
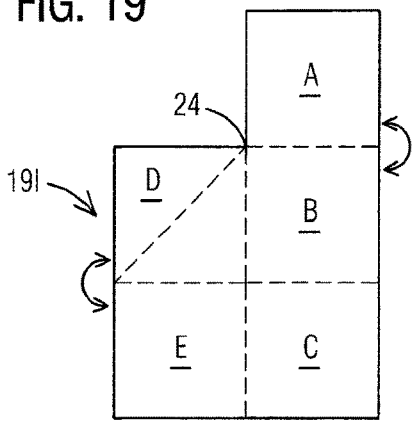
FIG. 19 is a top view of an unfolded left folded corner support.
Figure 20:
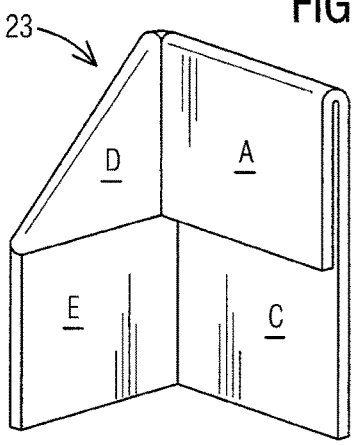
FIG. 20 is a perspective right side view of a folded left folded corner support.

As illustrated in FIGS. 19 and 20, the left side structure 3 further comprises a left folded corner support 23 folded out of a fourth sheet 19*l* wherein quadrant A is folded at a ninety degree angle in relation to quadrant B. Quadrants B and C are folded at a ninety degree angle in relation to quadrants D and E. Then, quadrant D is folded in half to create a forty five degree angle as quadrant E is folded inward along the central axis 24 to create a ninety degree angle between quadrants C and E.

The left folded seat support 21 may then be inserted or nested into the left folded corner support 23 to create the left side structure 3 as illustrated in FIG. 21.

Figure 10:
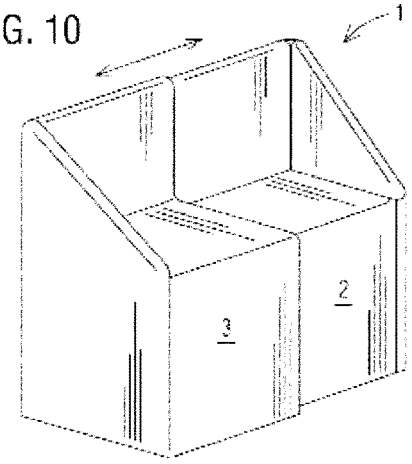
FIG. 10 is a perspective left side view of a furniture and display system of the present invention having a right side structure and a left side structure nested together in a primary configuration and constructed out of foldable sheets of material.
Figure 11:
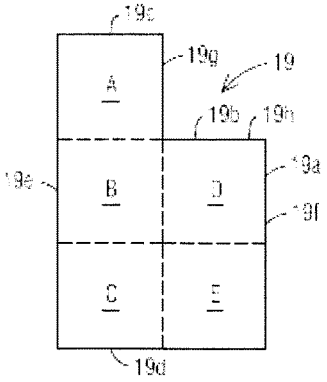
FIG. 11 is a top view of a foldable sheet of material.

Finally, the left side structure 3 may be inserted or nested into the right side structure 2, or vice versa, as illustrated in FIG. 10 to create an assembled furniture and display system 1 of the present invention.

With reference to FIGS. 22 and 23, a furniture and display system 1 of the present invention configured as a table is illustrated. The table may be adjusted length wise to accommodate a desired wall space or corner. When placed against an inside corner of a wall, a space is left for an additional display behind the table, such as a mannequin. Multiple tables may be placed next to each other at ninety degree angles to form L-shaped to go around an outside corner of a wall or to create a square-shape having an opening for an additional display, such as a mannequin, in the center.

With reference to FIG. 24, a perspective front view of a foldable furniture and display system 1 of the present invention configured as a dump bin is illustrated. The dump bin may be used as a display in a retail setting for holding bulk merchandise, such as sports balls, pillows, stuffed animals and so forth.

With reference to FIG. 25, a perspective left side view of a furniture and display system 1 of the present invention configured as a point of purchase display is illustrated. The furniture and display system 1 is configured in the same configuration illustrated in FIG. 1 with the addition of the insert displayed in FIG. 8 to create a multi-shelf display. The multi-shelf display may available in various sizes. For example, a full size display may be placed on the floor or a small display that is placed on a countertop near a cash register.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A furniture and display system comprising:

a right side structure and a left side structure that are configurable to each other;

said right side structure having a substantially rectangular-shaped right rear panel having a right rear panel top edge, a right rear panel bottom edge, a right rear panel left side edge and a right rear panel right side edge;

said right side structure further having a right side panel extending perpendicularly from the right rear panel right side edge;

said right side panel having a right side panel top edge, a right side panel bottom edge, a right side panel rear edge and a right side panel front edge;

a substantially rectangular-shaped right front panel extending perpendicularly from the right side panel front edge;

said right front panel having a right front panel top edge, a right front panel bottom edge, a right front panel right side edge and a right front panel left side edge;

a substantially rectangular-shaped right horizontal support panel located between the right rear panel, the right side panel and the right front panel and being perpendicularly oriented in relation to the right rear panel, the right side panel and the right front panel;

said right horizontal support panel having a right horizontal support panel front edge, a right horizontal support panel rear edge, a right horizontal support panel right side edge and a right horizontal support panel left side edge;

said right horizontal support panel front edge being adjacent to the right front panel top edge;

said left side structure having a substantially rectangular-shaped left rear panel having a left rear panel top edge, a left rear panel bottom edge, a left rear panel left side edge and a left rear panel right side edge;

said left side structure further having a left side panel extending perpendicularly from the left rear panel left side edge;

said left side panel having a left side panel top edge, a left side panel bottom edge, a left side panel rear edge and a left side panel front edge;

a substantially rectangular-shaped left front panel extending perpendicularly from the left side panel front edge;

said left front panel having a left front panel top edge, a left front panel bottom edge, a left front panel right side edge and a left front panel left side edge;

a substantially rectangular-shaped left horizontal support panel located between the left rear panel, the left side panel and the left front panel and being perpendicularly oriented in relation to the left rear panel, the left side panel and the left front panel;

said left horizontal support panel having a left horizontal support panel front edge, a left horizontal support panel rear edge, a left horizontal support panel right side edge and a left horizontal support panel left side edge;

said left horizontal support panel front edge being adjacent to the left front panel top edge;

said right rear panel comprises two panels, one of which is a full rear panel and the second of which is a partial rear panel;

said full rear panel and partial rear panel being spaced apart a predetermined distance;

said left rear panel made up of a single rear panel that slides between the full rear panel and the partial rear panel of the right side rear panel;

said right side panel top edge angles downward from the right rear panel top edge to the right front panel top edge; and said left side panel top edge angles downward from the left rear panel top edge to the left front panel top edge.

2. The furniture and display system of claim 1 wherein:

said right side structure is constructed out of at least one foldable sheet of material; and said left side structure is constructed out of at least one foldable sheet of material.

3. The furniture and display system of claim 2 wherein:

said right side structure comprises a right corner support and a right seat support nested together to form the right side structure; and said left side structure comprises a left corner support and a left seat support nested together to form the left side structure.

4. The furniture and display system of claim 1 further comprising:

at least one leveling insert configurable to the furniture and display system.

5. The furniture and display system of claim 1 further comprising:

at least one shelving insert configurable to the furniture and display system.

6. The furniture and display system of claim 1 further comprising:

at least one divider insert configurable to the furniture and display system.

7. A furniture and display system comprising:

a right side structure and a left side structure that are configurable to each other;

said right side structure having a substantially rectangular-shaped right rear panel having a right rear panel top edge, a right rear panel bottom edge, a right rear panel left side edge and a right rear panel right side edge;

said right side structure further having a right side panel extending perpendicularly from the right rear panel right side edge;

said right side panel having a right side panel top edge, a right side panel bottom edge, a right side panel rear edge and a right side panel front edge;

a substantially rectangular-shaped right front panel extending perpendicularly from the right side panel front edge;

said right front panel having a right front panel top edge, a right front panel bottom edge, a right front panel right side edge and a right front panel left side edge;

a substantially rectangular-shaped right horizontal support panel located between the right rear panel, the right side panel and the right front panel and being perpendicularly oriented in relation to the right rear panel, the right side panel and the right front panel;

said right horizontal support panel having a right horizontal support panel front edge, a right horizontal support panel rear edge, a right horizontal support panel right side edge and a right horizontal support panel left side edge;

said right horizontal support panel front edge being adjacent to the right front panel top edge;

said left side structure having a substantially rectangular-shaped left rear panel having a left rear panel top edge, a left rear panel bottom edge, a left rear panel left side edge and a left rear panel right side edge;

said left side structure further having a left side panel extending perpendicularly from the left rear panel left side edge;

said left side panel having a left side panel top edge, a left side panel bottom edge, a left side panel rear edge and a left side panel front edge;

a substantially rectangular-shaped left front panel extending perpendicularly from the left side panel front edge;

said left front panel having a left front panel top edge, a left front panel bottom edge, a left front panel right side edge and a left front panel left side edge;

a substantially rectangular-shaped left horizontal support panel located between the left rear panel, the left side panel and the left front panel and being perpendicularly oriented in relation to the left rear panel, the left side panel and the left front panel;

said left horizontal support panel having a left horizontal support panel front edge, a left horizontal support panel rear edge, a left horizontal support panel right side edge and a left horizontal support panel left side edge;

said left horizontal support panel front edge being adjacent to the left front panel top edge;

said left rear panel comprises two panels, one of which is a full rear panel and the second of which is a partial rear panel;

said full rear panel and partial rear panel being spaced apart a predetermined distance;

said right rear panel made up of a single rear panel that slides between the full rear panel and the partial rear panel of the left side rear panel;

said right side panel top edge angles downward from the right rear panel top edge to the right front panel top edge; and said left side panel top edge angles downward from the left rear panel top edge to the left front panel top edge.

8. The furniture and display system of claim 7 wherein:

said right side structure is constructed out of at least one foldable sheet of material; and said left side structure is constructed out of at least one foldable sheet of material.

9. The furniture and display system of claim 8 wherein:

said right side structure comprises a right corner support and a right seat support nested together to form the right side structure; and said left side structure comprises a left corner support and a left seat support nested together to form the left side structure.

10. The furniture and display system of claim 7 further comprising:

at least one leveling insert configurable to the furniture and display system.

11. The furniture and display system of claim 7 further comprising:

at least one shelving insert configurable to the furniture and display system.

12. The furniture and display system of claim 7 further comprising:

at least one divider insert configurable to the furniture and display system.

13. A furniture and display system comprising:

a right side structure and a left side structure that are configurable to each other;

said right side structure having a substantially rectangular-shaped right rear panel having a right rear panel top edge, a right rear panel bottom edge, a right rear panel left side edge and a right rear panel right side edge;

said right side structure further having a right side panel extending perpendicularly from the right rear panel right side edge;

said right side panel having a right side panel top edge, a right side panel bottom edge, a right side panel rear edge and a right side panel front edge;

a substantially rectangular-shaped right front panel extending perpendicularly from the right side panel front edge;

said right front panel having a right front panel top edge, a right front panel bottom edge, a right front panel right side edge and a right front panel left side edge;

a substantially rectangular-shaped right horizontal support panel located between the right rear panel, the right side panel and the right front panel and being perpendicularly oriented in relation to the right rear panel, the right side panel and the right front panel;

said right horizontal support panel having a right horizontal support panel front edge, a right horizontal support panel rear edge, a right horizontal support panel right side edge and a right horizontal support panel left side edge;

said right horizontal support panel front edge being adjacent to the right front panel top edge;

said left side structure having a substantially rectangular-shaped left rear panel having a left rear panel top edge, a left rear panel bottom edge, a left rear panel left side edge and a left rear panel right side edge;

said left side structure further having a left side panel extending perpendicularly from the left rear panel left side edge;

said left side panel having a left side panel top edge, a left side panel bottom edge, a left side panel rear edge and a left side panel front edge;

a substantially rectangular-shaped left front panel extending perpendicularly from the left side panel front edge;

said left front panel having a left front panel top edge, a left front panel bottom edge, a left front panel right side edge and a left front panel left side edge;

a substantially rectangular-shaped left horizontal support panel located between the left rear panel, the left side panel and the left front panel and being perpendicularly oriented in relation to the left rear panel, the left side panel and the left front panel;

said left horizontal support panel having a left horizontal support panel front edge, a left horizontal support panel rear edge, a left horizontal support panel right side edge and a left horizontal support panel left side edge;

said left horizontal support panel front edge being adjacent to the left front panel top edge;

said right side panel top edge angles downward from the right rear panel top edge to the right front panel top edge; and said left side panel top edge angles downward from the left rear panel top edge to the left front panel top edge.

* * * * *